US009815673B2

(12) United States Patent
Borntrager et al.

(10) Patent No.: US 9,815,673 B2
(45) Date of Patent: Nov. 14, 2017

(54) LOAD SECURING DEVICE FOR LIFT TRUCKS

(71) Applicants: Steven Borntrager, Grayson, KY (US); James Borntrager, Carrier Mills, IL (US)

(72) Inventors: Steven Borntrager, Grayson, KY (US); James Borntrager, Carrier Mills, IL (US)

( * ) Notice: Subject to any disclaimer, the term of this patent is extended or adjusted under 35 U.S.C. 154(b) by 0 days.

(21) Appl. No.: 15/159,697

(22) Filed: May 19, 2016

(65) Prior Publication Data

US 2017/0073202 A1 Mar. 16, 2017

Related U.S. Application Data

(60) Provisional application No. 62/219,613, filed on Sep. 16, 2015.

(51) Int. Cl.
*B66F 9/18* (2006.01)

(52) U.S. Cl.
CPC ..... *B66F 9/18* (2013.01)

(58) Field of Classification Search
CPC .. B66F 9/18; B62B 1/14; B60P 7/0823; B60P 7/083; Y10T 24/2175
USPC ..... 410/51, 103; 414/785, 448, 449; 187/237
See application file for complete search history.

(56) References Cited

U.S. PATENT DOCUMENTS

| | | | | | |
|---|---|---|---|---|---|
| 896,228 | A * | 8/1908 | Moore | B62B 1/14 | 410/51 |
| 2,623,760 | A * | 12/1952 | Fornelius | B62B 1/14 | 108/55.5 |
| 4,242,035 | A * | 12/1980 | Hornstein | B66F 9/065 | 37/405 |
| 4,527,309 | A * | 7/1985 | Kawahara | F16G 11/12 | 24/68 CD |
| 4,600,354 | A * | 7/1986 | Niewald | B66F 19/00 | 414/607 |
| 4,884,928 | A | 12/1989 | Nachtigall et al. | | |
| 5,012,599 | A * | 5/1991 | DeClair | E02F 3/401 | 37/444 |
| 5,624,222 | A * | 4/1997 | Hiatt | B66F 9/18 | 269/17 |
| 6,062,781 | A * | 5/2000 | Glaser | B60P 3/002 | 410/100 |

(Continued)

*Primary Examiner* — Anna Momper
*Assistant Examiner* — Mark Hageman
(74) *Attorney, Agent, or Firm* — Richard C. Litman

(57) ABSTRACT

The load securing device for lift trucks includes various embodiments adapted for installation upon powered hand trucks, forklifts, and pallet jacks. Each embodiment includes an upright for attachment to the lift truck structure, the upright having a tensioner installed at its upper end or elsewhere opposite the forks of the lift truck. A tensioning element (e.g., tiedown strap, etc.) passes through the tensioner, and a chain and hook extends from the distal end of the tensioning element. The hook of the load securing device is hooked to the load carried on the forks of the lift truck, and the tensioner is tightened to pull and hold the load up adjacent the vertical structure of the lift truck at the back of the forks. Two load securing devices can be used with a powered hand truck for securing a small portable building structure for movement.

14 Claims, 9 Drawing Sheets

(56) References Cited

U.S. PATENT DOCUMENTS

| | | | | |
|---|---|---|---|---|
| 6,287,062 | B1 * | 9/2001 | Valiance | B60P 7/0823 410/100 |
| 6,709,222 | B2 | 3/2004 | Inman, Jr. | |
| 2004/0076501 | A1 | 4/2004 | McGill et al. | |
| 2010/0215455 | A1 | 8/2010 | Burris | |
| 2014/0166405 | A1 | 6/2014 | Bow et al. | |

* cited by examiner

LOAD SECURING DEVICE FOR LIFT TRUCKS

CROSS-REFERENCE TO RELATED APPLICATION

This application claims the benefit of U.S. Provisional Patent Application Ser. No. 62/219,613, filed Sep. 16, 2015.

BACKGROUND OF THE INVENTION

1. Field of the Invention

The present invention relates generally to tiedown and other load and cargo securing devices and systems, and particularly to a load securing device for lift trucks that provides positive attachment to the base of an object being carried on or by the forks of a lift truck.

2. Description of the Related Art

Various lift trucks have been developed in the past, with most having adjustable forks extending from the forward end thereof. Perhaps the best known of these devices is the forklift wherein the vehicle includes a prime mover (generally an internal combustion engine, but often an electric motor) for moving the vehicle from place to place, with the prime mover also powering a hydraulic pump to provide power for the operation of the lift forks.

Another type of lift truck is the powered hand truck, a powered vehicle having two main wheels that are steered by independent braking or drive. A small platform is provided at the rear of the vehicle for the operator. Such a powered lift truck is disclosed in U.S. Pat. No. 7,597,522 issued to Steven Borntrager et al. on Oct. 6, 2009, which is incorporated herein by reference in its entirety.

Still another type of lift truck is the pallet jack, in which the lift forks are generally manually powered by a hand or foot pump or the like, although they may be powered by another power source in some variations. All of these devices have in common a pair of lift forks extending from the forward end thereof.

A chronic problem with such forked lift trucks and vehicles is that the load being carried is generally not positively secured to the vehicle. Forklifts commonly provide for the rear tilt of the entire forklift carriage, in order to reduce the chance of the load slipping forward off the forks. However, this is not an absolute remedy for this potential hazard, and other lift trucks may not provide for such rearward tilt of the forks at all.

Thus a load securing device for lift trucks solving the aforementioned problems is desired.

SUMMARY OF THE INVENTION

The load securing device for lift trucks comprises various embodiments adapted for installation upon powered hand trucks, forklifts, and pallet jacks. Each embodiment includes an upright for attachment to the lift truck structure, the upright having a tensioner (e.g., strap ratchet, etc.) installed at its upper end opposite the forks of the lift truck. A tensioning element (e.g., tiedown or nylon strap, etc.) passes through the tensioner, with a chain and hook extending from the distal end of the tensioning element. Two load securing devices are installed as a pair on the lift structure. The hooks of the two load securing devices are hooked to the load being carried on the forks of the lift truck, and the tensioners are tightened to pull and hold the load adjacent to the vertical structure of the lift truck at the back of the forks. The load securing device is particularly well-suited for use with the powered hand truck as described in U.S. Pat. No. 7,597,522 for securing a small portable building structure to the powered hand truck for transport or relocation, although it is adaptable to numerous other types of lift trucks and loads.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The load securing device for lift trucks comprises various embodiments of an attachment for powered lift trucks, forklifts, pallet jacks, and similar machines having fork tines extending forwardly therefrom, for the secure carriage of large bulky objects thereon. The various embodiments differ in the length or height of the rigid uprights used to attach the devices to the lift truck, depending upon the type or configuration of lift truck, and the configuration of the hook members for attaching to the load.

Figure 1:
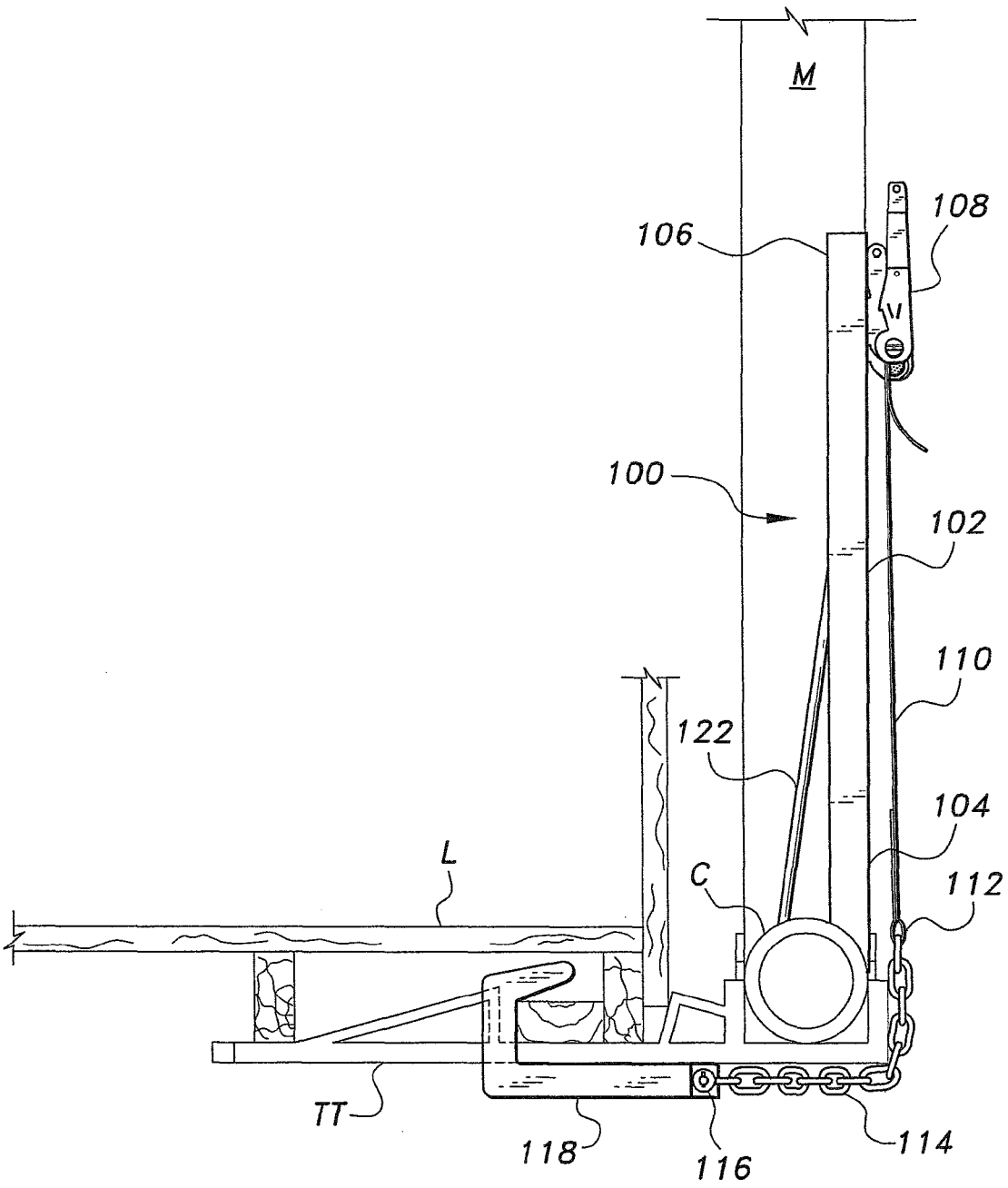
FIG. 1 is a detailed environmental elevation view of a load securing device for lift trucks according to the present invention, illustrating its operation.
Figure 2:
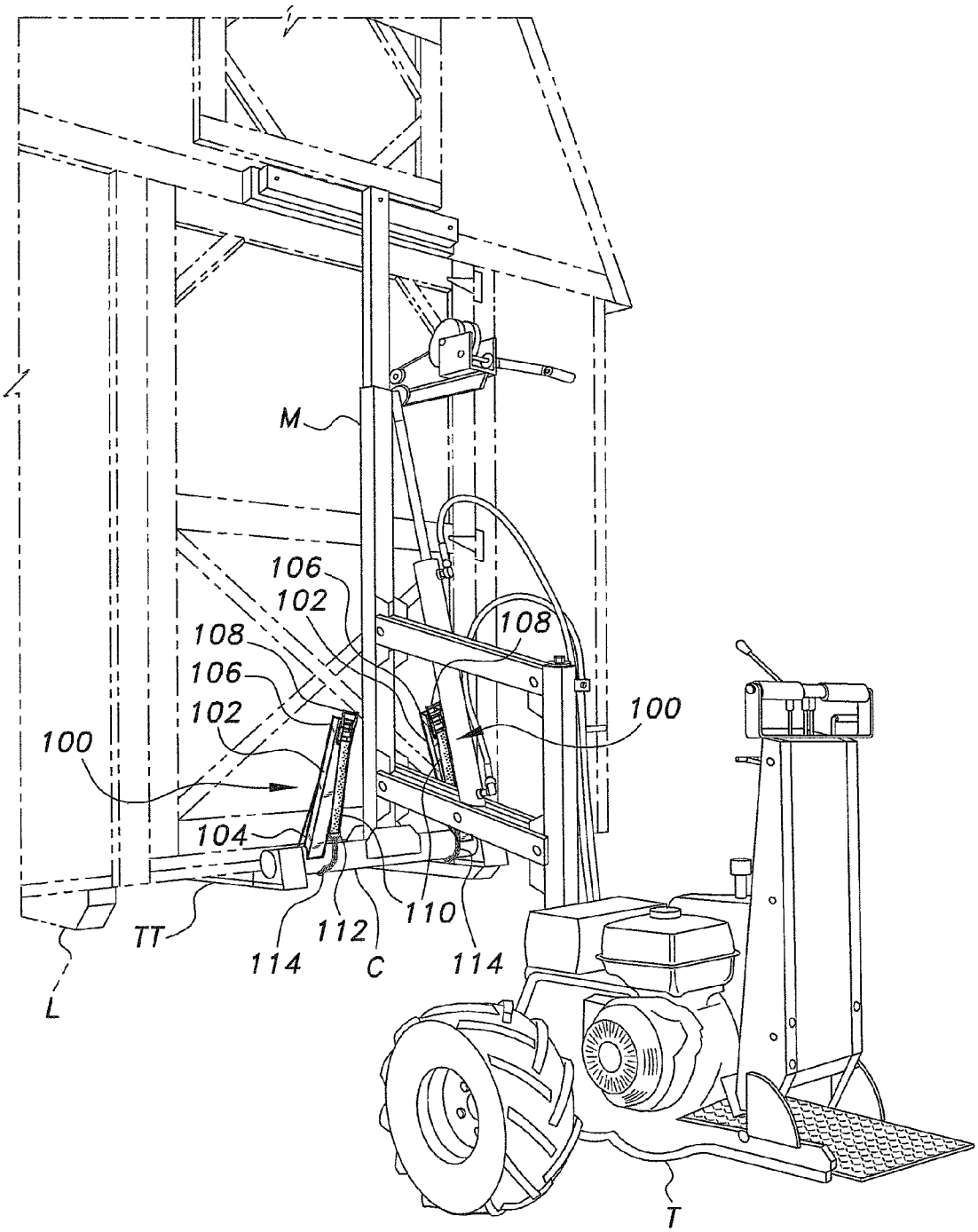
FIG. 2 is an environmental perspective view of the load securing device for lift trucks of FIG. 1, showing the device installed upon a powered hand truck.

FIGS. 1 and 2 of the drawings illustrate a first embodiment of the load securing device 100, installed on a powered hand truck T. The powered hand truck T includes a mast M with a laterally disposed crossmember C at the bottom end thereof, with two laterally spaced fork tines TT extending forwardly from the crossmember C (only one such tine TT is visible in the drawings). Two such load securing devices 100 are preferably installed as a pair, with the two devices 100 being laterally separated from one another and attached to the crossmember C adjacent the respective fork tines TT to extend upward from the crossmember C. Each load securing device 100 includes an upright 102 having a lower end 104 welded or otherwise affixed (e.g., rigidly and immovably affixed) to the crossmember C, and an opposite upper end 106. The upright 102 is preferably formed from a length of rectangular section steel channel with a plate welded across the span of the open channel at the upper end portion 106 thereof to close the channel at the upper end portion, with the resulting closed box structure remaining open at its extreme end. Other materials may be used as desired.

Figure 8:
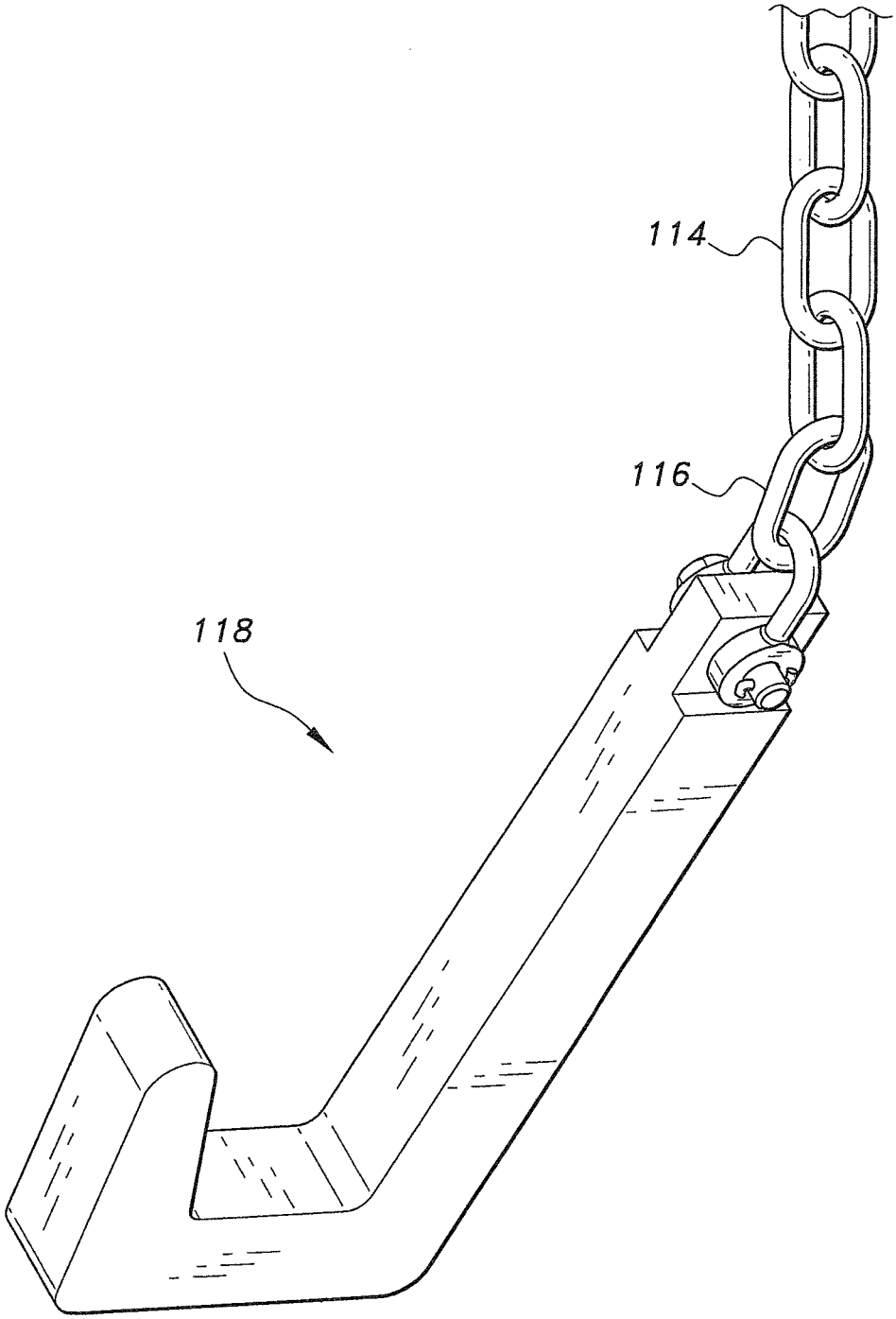
FIG. 8 is a detailed perspective view of one embodiment of a hook member for installation and use with the load securing device for lift trucks according to the present invention.
Figure 9:
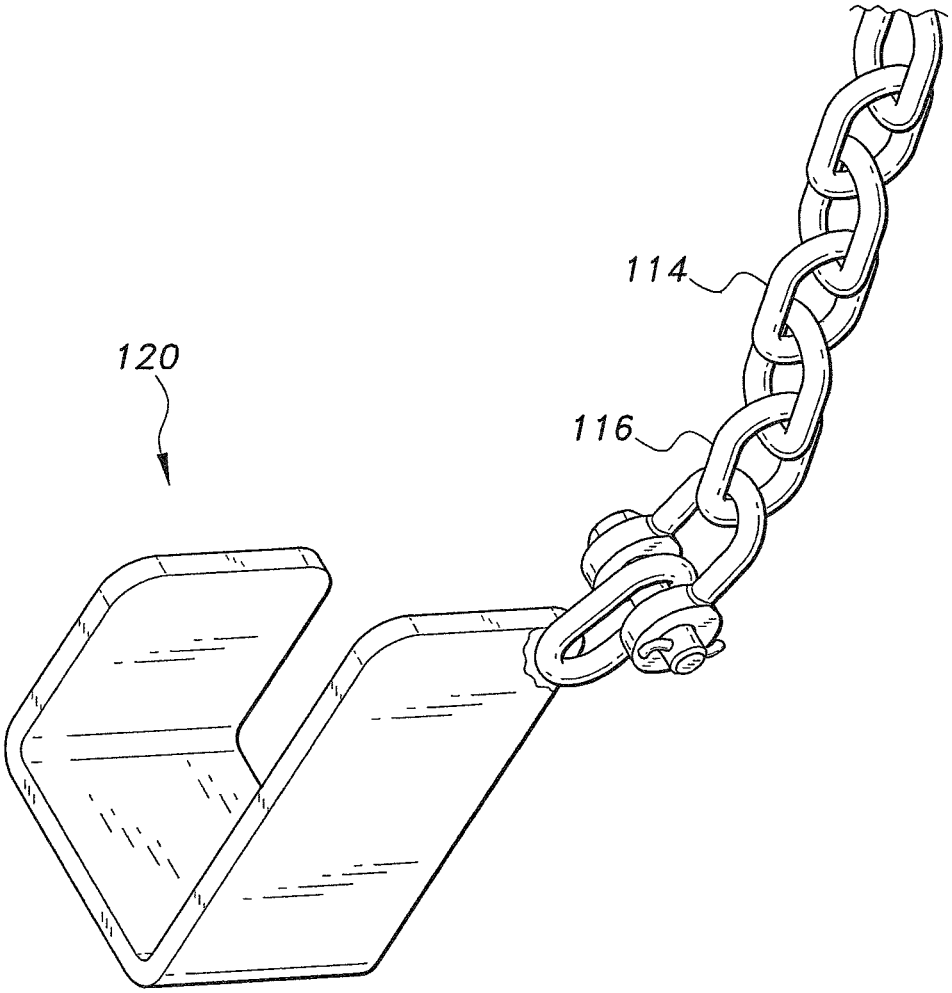
FIG. 9 is a detailed perspective view of another embodiment of a hook member for installation and use with the load securing device for lift trucks according to the present invention.

A tensioner 108, e.g., a tiedown strap ratchet or the like, is affixed (e.g., bolted, welded, etc.) to the upper end 106 of the upright 102, e.g., opposite the forwardly oriented truck fork tines TT. The tensioner 108 is oriented so that its takeup reel is oriented downward to allow its flexible tension element 110 (referred to as a tiedown strap, a ratchet strap, or a nylon strap) to wind and unwind downward therefrom, generally along the length of the upright 102. Each tension element 110 has a distal end 112, with a load attachment extending therefrom. The load attachment may comprise a length of chain 114 having a distal end 116 opposite its attachment to the distal end 112 of the tension element 110. A hook member 118 extends from the chain 114 for removable attachment to the structure of the load L being carried or moved by the powered lift truck T. The hook member 118 may comprise a heavy length of bar stock cut, forged, or otherwise formed of durable steel, as shown in detail in FIG. 8 of the drawings, or other suitable component as desired. FIG. 9 illustrates an alternative hook member 120, formed of a section of heavy rectangular plate having a U-channel formed at one end.

Figure 3:
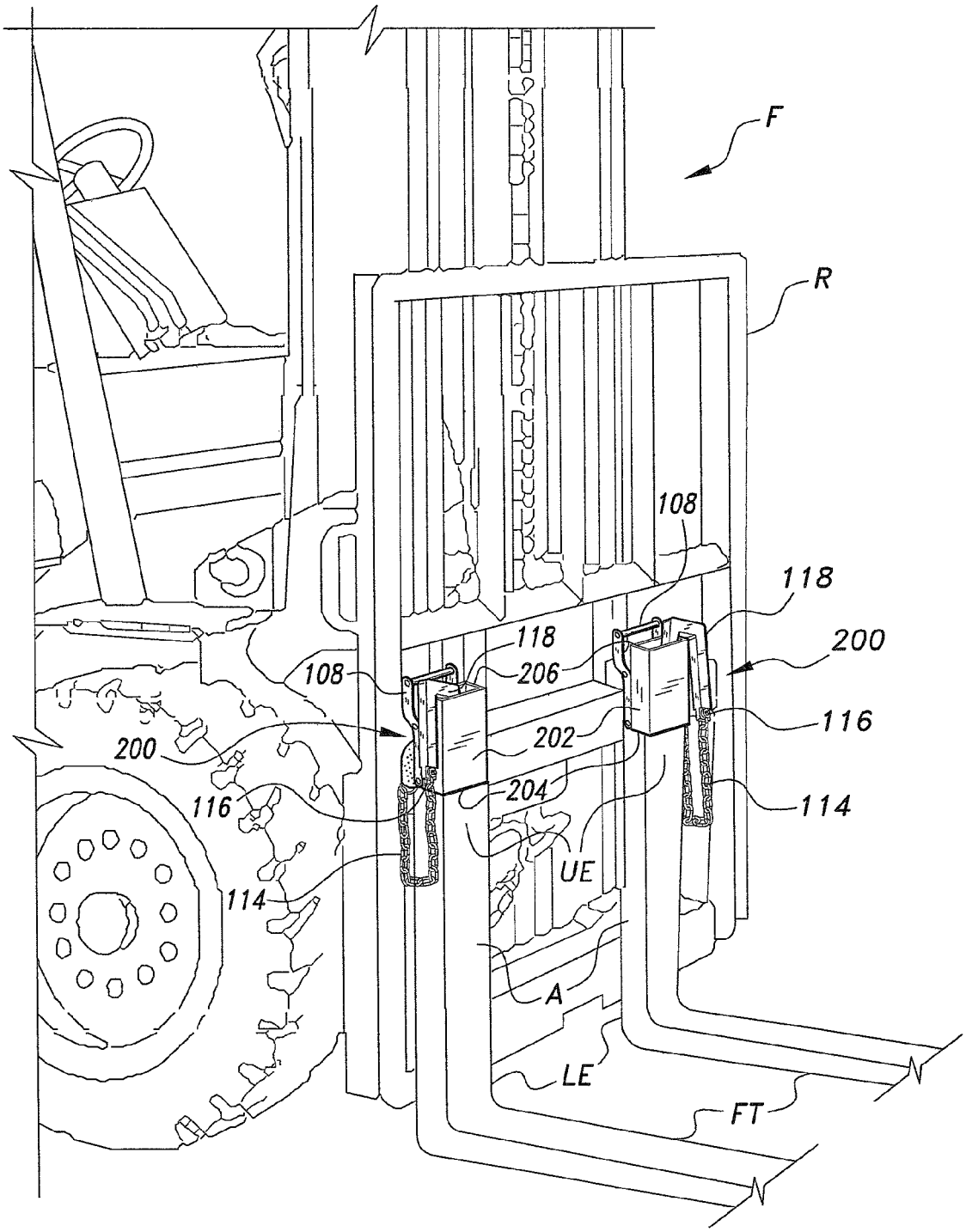
FIG. 3 is an environmental perspective view of a second embodiment of the load securing device for lift trucks according to the present invention, showing the device installed upon the forks of a forklift.

FIG. 3 of the drawings illustrates an alternative embodiment, designated as load securing device or device 200. The only difference between the load securing device 200 and the load securing device 100 of FIGS. 1 and 2 is the length of the upright 202. The load securing device 200 of FIG. 3 is installed upon an otherwise conventional forklift F having a mast, a carriage R movably mounted on the mast, and laterally spaced tines FT attached to the carriage R. Each tine FT has a vertical leg A having an upper end UE and an opposite lower end LE.

The lower end 204 of each upright 202 is rigidly affixed (e.g., by welding) to the upper end UE of a corresponding vertical leg A of a tine FT. As the vertical legs A have some substantial vertical extent, the uprights 202 need not be so long or tall as the uprights 102 of the embodiment of FIGS. 1 and 2. Otherwise, the load securing device 200 includes the same components and structure as described further above for the embodiment 100 of FIGS. 1 and 2, with a tensioner 108, e.g., a tiedown strap ratchet or the like, rigidly and permanently affixed to the upper end or upper end portion 206 of the upright 202 to the back side thereof, i.e., opposite the forwardly oriented forklift tines FT. The tensioner 108 is oriented so that its takeup reel is oriented downward to allow its flexible tension element 110 (not visible in FIG. 3, but comprising a tiedown strap or the like, as shown in FIGS. 1 and 2) to wind and unwind downward therefrom, generally along the length of the upright 202 and the tine's vertical leg A. Each tension element 110 has a distal end 112 (not shown in FIG. 3), with a load attachment extending therefrom. The load attachment may comprise a length of chain 114 having a distal end 116 opposite its attachment to the distal end 112 of the tension element 110, with a hook member 118 (or alternatively, the hook member 120 shown in detail in FIG. 9) extending therefrom for removable attachment to the structure of the load L being carried or moved by the forklift F, as in the powered hand truck T of FIGS. 1 and 2. The open ended channel configuration of the uprights 202 (or uprights 102 of FIGS. 1 and 2), shown in FIG. 3, permits the distal end of the hook 118 (or other hook) to be hooked over the open upper end 206 of the upright 202 for convenient carriage of the hook and chain assembly, particularly when the tension element (e.g., tiedown strap) has been retracted onto or into the tensioner 108.

Figure 4:
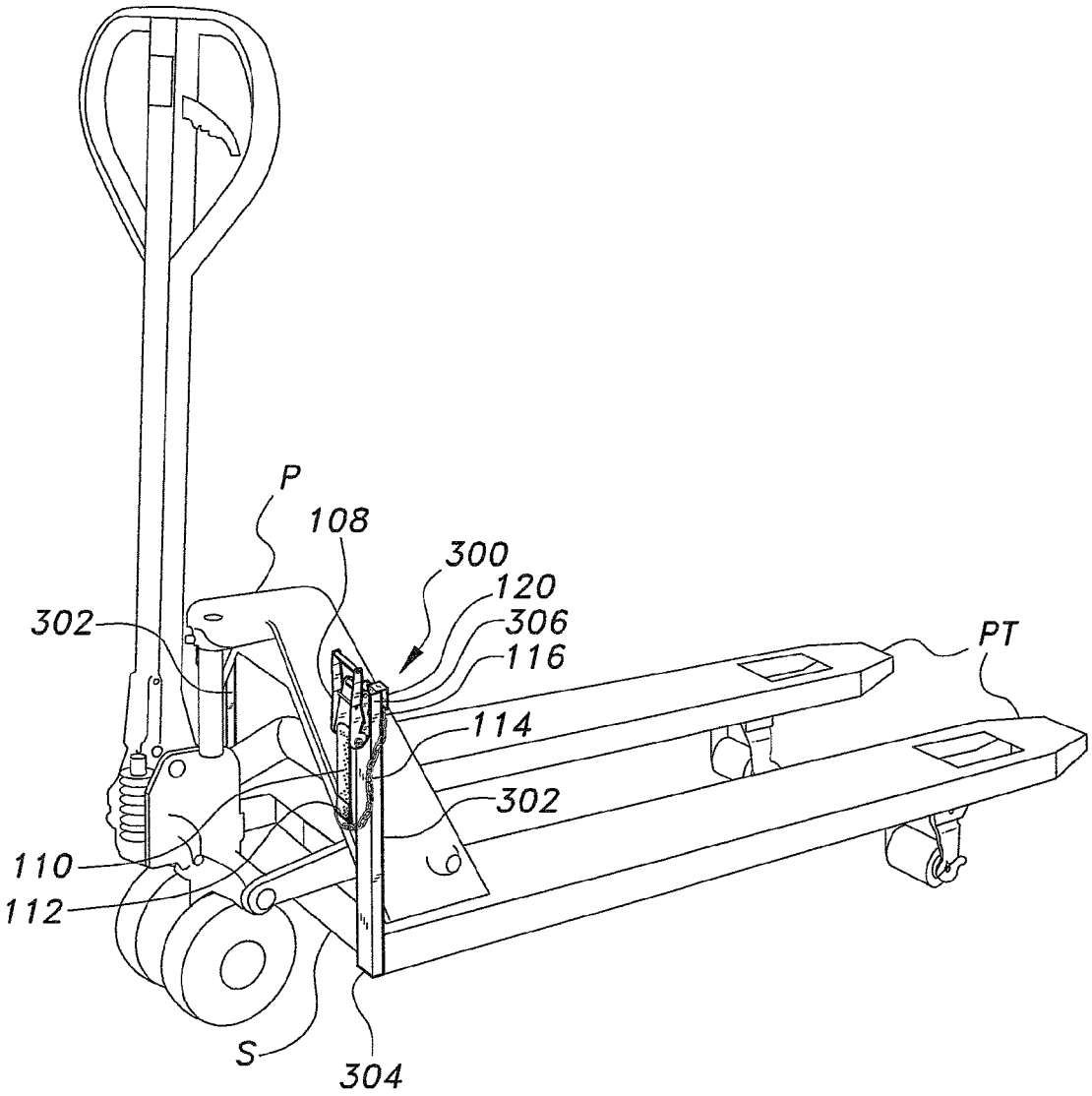
FIG. 4 is an environmental perspective view of a third embodiment of the load securing device for lift trucks according to the present invention, showing the device installed upon a pallet jack.

FIG. 4 of the drawings illustrates an alternative embodiment, designated as load securing device or device 300. The load securing device 300 of FIG. 4 is installed upon a conventional pallet jack P having a rearward structure S with a pair of pallet jack tines PT extending forwardly therefrom. The lower ends 304 of the first and second uprights 302 are rigidly and immovably affixed (welding, etc.) to the structure S of the pallet jack P, and/or to the rearward ends of the two fork tines PT. The only difference between the load securing device 300 and the load securing device 200 of FIG. 3 is the length of the upright 302, with the uprights 302 having lengths or heights similar to those of the uprights 102 of the embodiment 100 of FIGS. 1 and 2. As the rearward ends of the two fork tines are quite close to the underlying surface, the lower ends 304 of the uprights 302 are also close to the underlying surface, with their upper ends 306 extending upward for some distance or length above their lower attachment ends 304.

Otherwise, the load securing devices 300 include the same components and structure as described further above for the embodiments 100 and 200 of FIGS. 1 through 3, with each having a tensioner 108, e.g., a tiedown strap ratchet or the like, rigidly affixed to the upper end or upper end portion 306 of the upright 302 to the back side thereof, i.e., opposite the forwardly oriented pallet jack tines PT. The tensioner 108 is oriented so that its takeup reel is oriented downward to allow its flexible tension element 110 to wind and unwind downward therefrom, generally along the length of the upright 302. Each tension element 110 has a distal end 112, with a load attachment extending therefrom. The load attachment may comprise a length of chain 114 having a distal end 116 opposite its attachment to the distal end 112 of the tension element 110, with a hook member 118 (or alternatively, the hook member 120 shown in detail in FIG. 9) extending therefrom for removable attachment to the structure of the load being carried or moved by the pallet jack P, as in the powered hand truck T of FIGS. 1 and 2. It will be noted in FIG. 4 that the hook member 120 is stowed by hooking its distal end into the open upper end 306 of the upright 302, similarly to the stored disposition of the hook member 118 shown for the embodiment 200 illustrated in FIG. 3.

Figure 5:
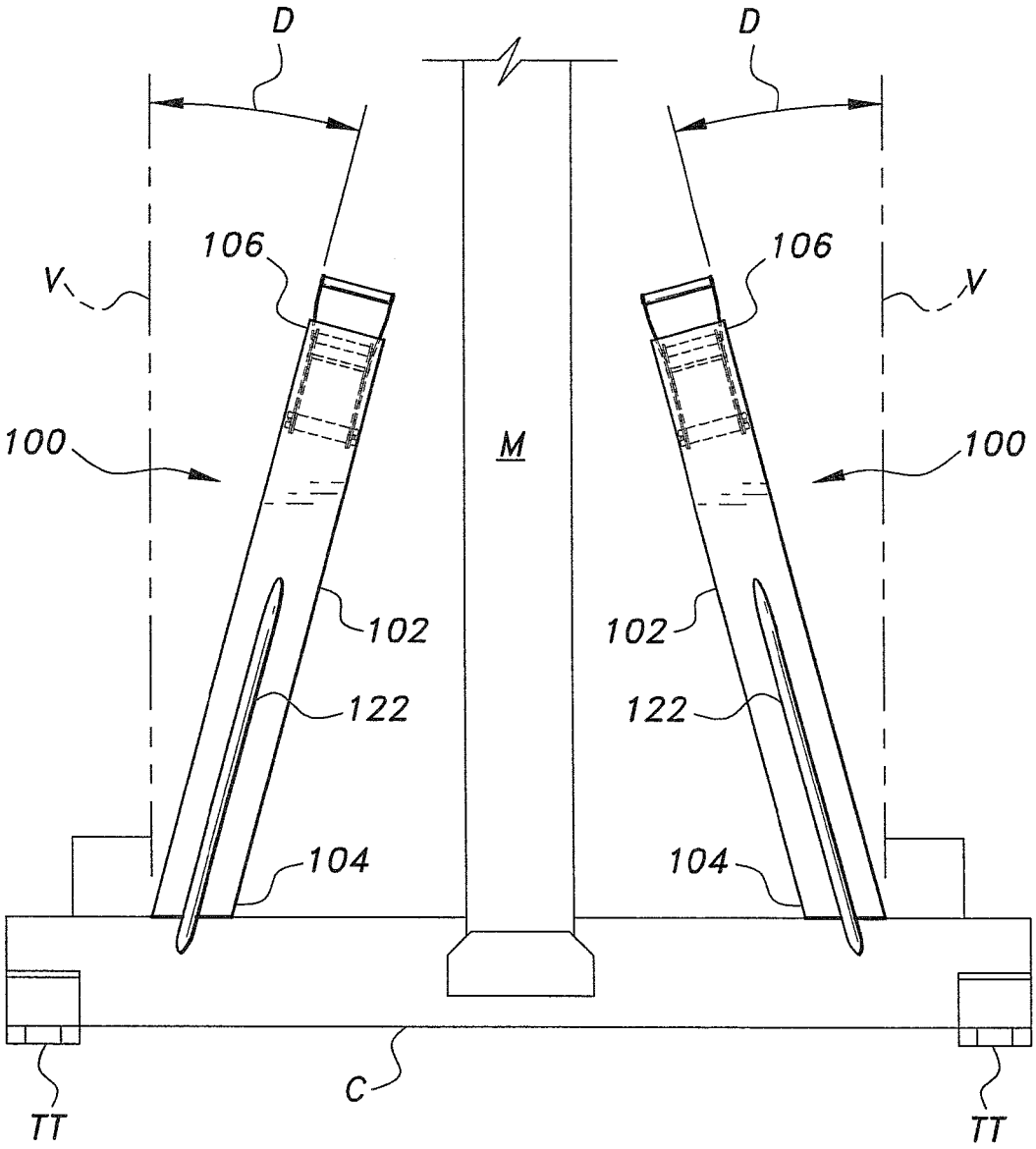
FIG. 5 is a front elevation view of the load securing device for lift trucks of the embodiment of FIG. 1, illustrating the angular disposition of the uprights.

FIG. 5 of the drawings illustrates further details of the load securing device for lift trucks, particularly the embodiment 100 of FIGS. 1 and 2. It will be noted that the forks TT of the powered lift truck T are not laterally adjustable, i.e., they define a fixed distance therebetween. In many instances, relatively large and wide loads must be supported by the two fork tines TT, as in the example illustrated in FIG. 1. Accordingly, it is desirable to space the two hook members 118 or 120 relatively widely apart, in order to provide longer lateral arms from the center of the load to the attachments of the two hook members 118 or 120 to the load. It will be seen that this arrangement will spread the two tension elements 110 and their chains 114 laterally, which applies an outward lateral load on the two uprights 102 if those uprights are installed vertically to the crossmember C.

Accordingly, the two uprights 102 are preferably installed so that their upper ends 106 are angled toward one another from the vertical (assuming the crossmember C is horizontal), as represented by the vertical lines V in FIG. 5. This places the upper ends 106 of the two uprights 102 closer to one another and to the central mast M than their lower ends 104, as shown by the angular displacements D in FIG. 5. Thus, the outwardly angled tension elements 110 extend along paths substantially parallel to the two uprights 102, as shown in FIG. 2, thereby obviating or at least substantially reducing lateral forces on the uprights 102.

FIG. 5 also provides a front elevation view of an additional brace structure that may be installed with the load securing devices 100. The two braces 122 extend between the lift truck structure, e.g., the crossmember C (shown in FIGS. 1, 2, and 5) of the powered lift truck T illustrated in FIG. 2, and the respective upright 102, e.g., attaching to the medial portion thereof. The two braces 122 provide some additional fore and aft reinforcement for the attachments of the lower ends 104 of the uprights 102 to the crossmember C in the embodiment 100 of FIGS. 1, 2, and 5. It will be seen that the inwardly angled upper ends of the uprights, and braces for the uprights, may be applied to any of the embodiments described herein, but are particularly effective in the load securing device 100 of FIGS. 1, 2, and 5.

Figure 6:
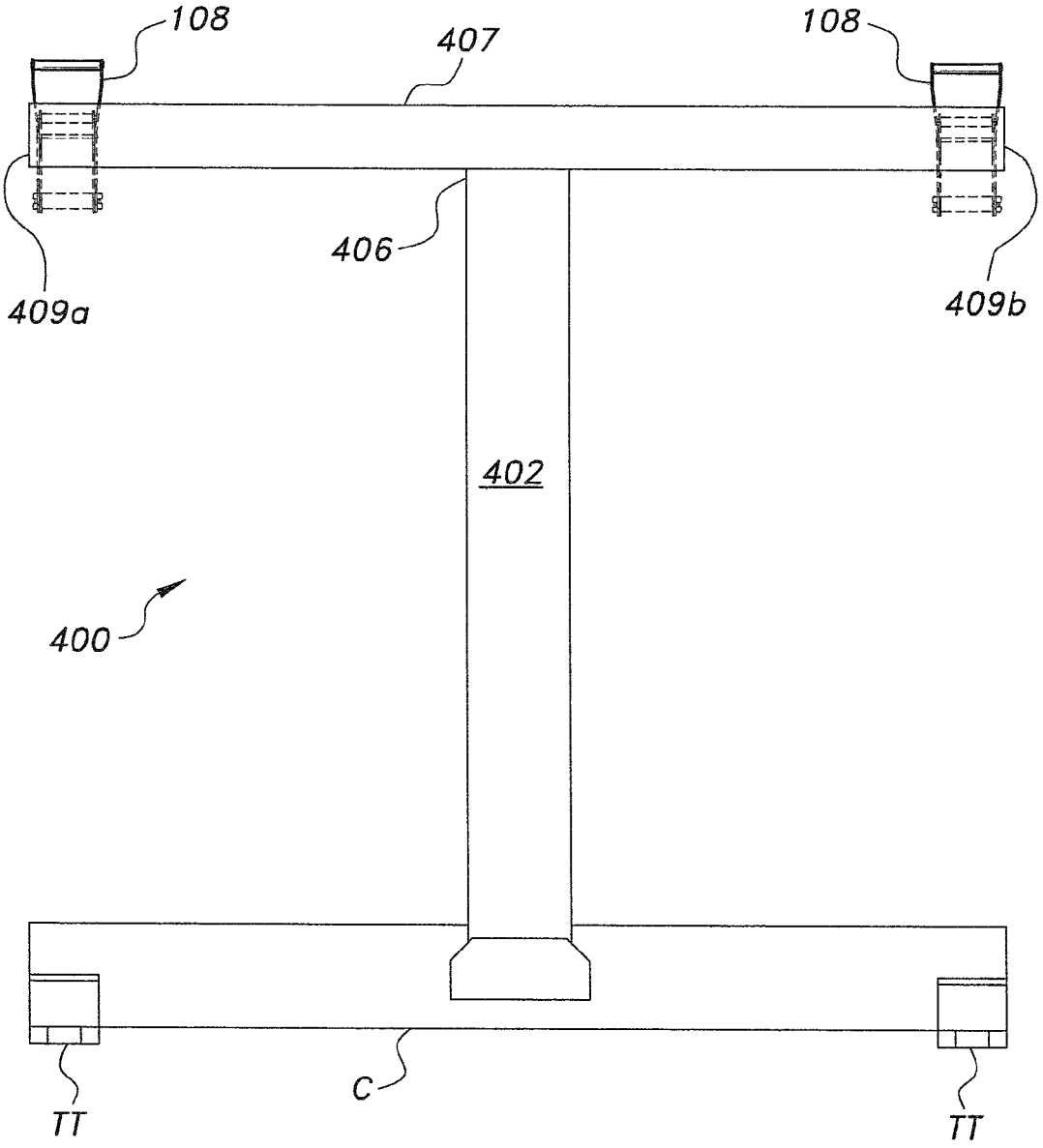
FIG. 6 is a front elevation view of a fourth embodiment of the load securing device for lift trucks according to the present invention, comprising a crossmember extending across the top of a single upright member.
Figure 7:
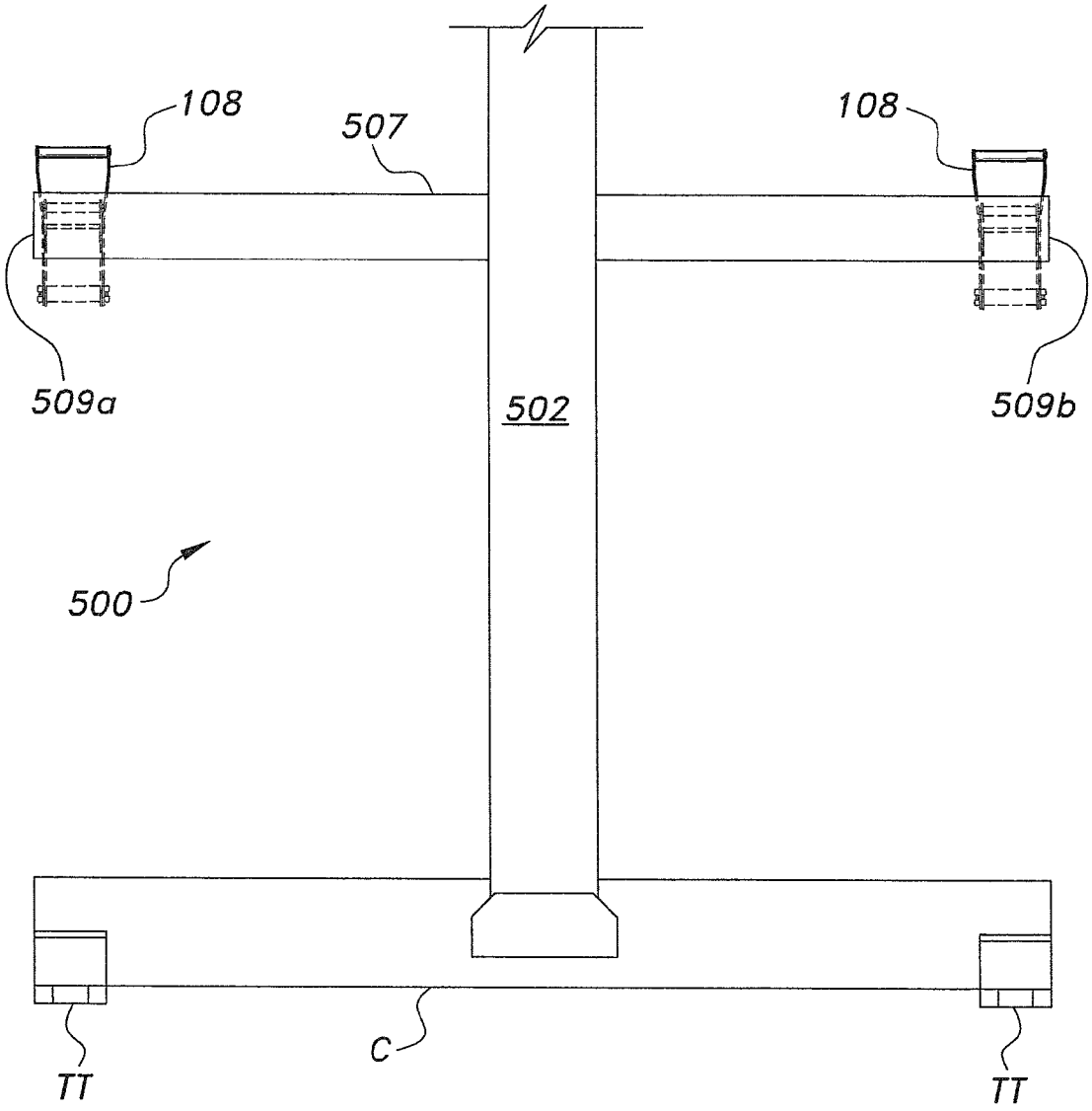
FIG. 7 is a front elevation view of a fifth embodiment of the load securing device for lift trucks according to the present invention, wherein the crossmember and single upright member have a cruciform configuration.

FIGS. 6 and 7 illustrate two additional embodiments of the load securing device for lift trucks. The embodiment 400 of FIG. 6 includes a single upright 402 extending upward from the center of the lateral crossmember C, with the upper end 406 of the upright 402 having a crossmember 407 extending laterally thereacross, essentially parallel to the lower crossmember C. Each end 409*a* and 409*b* has a tensioner 108 secured thereto. In this manner, the widely spread tensioners 108 have a sufficiently large span therebetween that it is not necessary to set them at an angle other than the vertical. This embodiment may be applied to any of the various lift truck configurations described herein, and/or other lift truck configurations, as practicable.

The load securing device 500 of FIG. 7 includes a single upright 502 extending upward from the center of the lateral crossmember C, with a crossmember 507 extending laterally thereacross, essentially parallel to the lower crossmember C. The crossmember 507 is installed at some point across the upright 502 below the upper end thereof, to form a generally cruciform configuration with the upright. The upright 502 may comprise the mast M of the powered hand truck embodiment 100 illustrated in FIGS. 1 and 2. Each end 509*a* and 509*b* of the crossmember 507 has a tensioner 108 secured thereto. In this manner, the widely spread tensioners 108 have a sufficiently large span therebetween that it is not necessary to set them at an angle other than the vertical. This embodiment is particularly applicable to the powered hand truck embodiment 100 of FIGS. 1 and 2, as noted above, but may be applied to any of the various lift truck configurations described herein, and/or other lift truck configurations, as practicable.

It is to be understood that the present invention is not limited to the embodiments described above, but encompasses any and all embodiments within the scope of the following claims.

We claim:

1. A load securing device for a lift truck, comprising:

a lift truck;

a pair of uprights, each of the uprights having a lower end and an upper end, the uprights being rigidly affixed and extending upward from the lift truck such that the upper ends of the uprights are closer to one another than the lower ends thereof;

a tensioner attached to each upright;

a flexible tension element adjustably attached to each tensioner, each flexible tension element having a distal end; and a hook attached to the distal end of each flexible tension element, each hook being adapted for releasable attachment to a load in order to secure the load to the lift truck.

2. The load securing device for a lift truck as recited in claim 1, wherein the lift truck comprises a powered hand truck having a lateral crossmember and laterally spaced fork tines extending forward from the crossmember.

3. The load securing device for a lift truck as recited in claim 1, wherein each flexible tension element comprises a nylon strap.

4. The load securing device for a lift truck as recited in claim 3, further comprising a chain between the distal end of each nylon strap and the respective hook.

5. The load securing device for a lift truck as recited in claim 4, wherein each hook is made from bar stock.

6. The load securing device for a lift truck as recited in claim 4, wherein each hook is made from elongate rectangular plate having a U-shaped channel formed in one end.

7. The load securing device for a lift truck as recited in claim 1, further comprising a brace attached to each upright.

8. A lifting system, comprising:

a powered hand truck having a lateral crossmember and a pair of laterally spaced fork tines extending forward from the crossmember, and a pair of load securing devices, each of the load securing devices including:

an upright having a lower end and an upper end, the lower end of the upright being rigidly attached to the crossmember adjacent a corresponding one of the tines, wherein the upper ends of the uprights are closer to one another than the lower ends thereof;

a tensioner attached to the upper end of the upright;

a flexible, elongate strap having a proximal end adjustably attached to the tensioner and having a distal end;

a chain extending from the distal end of the strap; and a hook attached to the chain, the hook being adapted for releasable attachment to a load in order to secure the load to the powered hand truck.

9. The lifting system according to claim 8, wherein each hook is made from bar stock.

10. The lifting system according to claim 8, wherein each hook is made from elongate rectangular plate having a U-shaped channel formed in one end.

11. The lifting system according to claim 8, further comprising a brace attached to each upright and said crossmember.

12. The lifting system according to claim 8, further comprising a mast vertically extending from the lateral crossmember.

13. A method of securing a load onto a lift truck, comprising the steps of:

providing a lifting system, the lifting system including:

i) a powered hand truck having a lateral crossmember and a pair of laterally spaced fork tines extending forward from the crossmember;

ii) a pair of load securing devices, each of the load securing devices including:

a. an upright having a lower end and an upper end, the lower end of the upright being rigidly attached to the crossmember adjacent a corresponding one of the tines, wherein the upper ends of the uprights are closer to one another than the lower ends thereof;

b. a tensioner attached to the upper end of the upright;

c. a flexible, elongate strap having a proximal end adjustably attached to the tensioner and having a distal end, wherein the tensioner and flexible elongate strap are oriented to wind and unwind along the length of its respective upright;

d. a chain extending from the distal end of the strap; and e. a hook attached to the chain, the hook being adapted for releasable attachment to a load in order to secure the load to the powered hand truck;

placing a load to be carried on the pair of laterally spaced fork tines;

extending the chain and hook under the crossmember and engaging the load; and tensioning the tensioners so as to pull and hold the load adjacent to the uprights.

14. A method of securing a load onto a lift truck according to claim 13, wherein said lateral crossmember further includes a mast vertically extending therefrom so as to support the carried load.

* * * * *